US006011474A

United States Patent [19]

Coffey et al.

[11] Patent Number: 6,011,474

[45] Date of Patent: Jan. 4, 2000

[54] MULTIPLE-USE DEACTIVATION DEVICE FOR ELECTRONIC ARTICLE SURVEILLANCE MARKERS

[75] Inventors: Kevin R. Coffey, Fremont, Calif.; Wing K. Ho, Boynton Beach; Richard L. Copeland, Boca Raton, both of Fla.

[73] Assignee: Sensormatic Electronics Corporation, Boca Raton, Fla.

[21] Appl. No.: 09/067,333

[22] Filed: Apr. 28, 1998

[51] Int. Cl.[7] ..... G08B 13/14

[52] U.S. Cl. ..... 340/572.3; 340/572.6; 340/572.7; 340/572.8

[58] Field of Search ..... 340/572.3, 572.5, 340/572.1, 572.2, 572.4, 572.6, 572.7, 572.8, 551; 343/867, 762; 361/149, 152, 267; 455/81; 324/260; 342/42, 44

[56] References Cited

U.S. PATENT DOCUMENTS

| | | | |
|---|---|---|---|
| 3,938,044 | 2/1976 | Lichtblau | 340/572.3 |
| 4,622,543 | 11/1986 | Anderson, III et al. | 340/572.1 |
| 5,008,649 | 4/1991 | Klein | 340/572.3 |
| 5,142,292 | 8/1992 | Chang | 343/742 |
| 5,210,524 | 5/1993 | Schwarz et al. | 340/572.3 |
| 5,341,125 | 8/1994 | Plonsky et al. | 340/572.3 |
| 5,493,275 | 2/1996 | Easter | 340/572.3 |
| 5,537,094 | 7/1996 | Bettine et al. | 340/572.4 |

*Primary Examiner*—Benjamin C. Lee
*Attorney, Agent, or Firm*—Robin, Blecker & Daley

[57] ABSTRACT

A single deactivation device is used to deactivate both harmonic type EAS markers and magnetomechanical type EAS markers. The deactivation device includes a housing, and a permanent magnet and a coil disposed within the housing. The coil is circular and is arranged concentrically with, and outside of, the permanent magnet. The permanent magnet forms a DC magnetic field for deactivating the harmonic type marker by magnetizing control elements thereof. The coil is driven to generate an AC magnetic field that deactivates the magnetomechanical type marker by degaussing a control element thereof. The maximum amplitude of the AC magnetic field is lower than the level of the DC magnetic field, and is substantially below the coercivity of the control elements of the harmonic type marker. The coercivity of the control element of the magnetomechanical type marker is low enough to be degaussed by the AC magnetic field.

26 Claims, 3 Drawing Sheets

MULTIPLE-USE DEACTIVATION DEVICE FOR ELECTRONIC ARTICLE SURVEILLANCE MARKERS

FIELD OF THE INVENTION

This invention relates generally to electronic article surveillance (EAS) and pertains more particularly to so-called deactivators for rendering EAS markers inactive.

BACKGROUND OF THE INVENTION

It has been customary in the electronic article surveillance industry to apply EAS markers to articles of merchandise. Detection equipment is positioned at store exits to detect attempts to remove goods with active markers from the store premises, and to generate an alarm in such cases.

When a customer presents an article for payment at a checkout counter, a checkout clerk deactivates the marker by using a deactivation device provided to deactivate the marker.

One type of EAS system is referred to as a harmonic system because it is based on the principle that a magnetic material passing through a magnetic field having a selected frequency disturbs the field and produces harmonic perturbations of the selected frequency. The detection system is tuned to recognize certain harmonic frequencies and, if present, causes an alarm. The harmonic frequencies generated are a function of the degree of non-linearity of the hysteresis loop of the magnetic material. An example of a harmonic EAS system is disclosed in U.S. Pat. No. 4,660,025, which is commonly assigned with the present application.

Another type of EAS system is known as a magnetomechanical system, and utilizes markers that include a magnetostrictive element. A system of this type is disclosed in U.S. Pat. No. 4,510,489. Markers used in magnetomechanical systems are formed of a ribbon-shaped length of a magnetostrictive amorphous material contained in an elongated housing in proximity to a bias magnetic element. The magnetostrictive element is fabricated such that it is resonant at a predetermined frequency when the bias element has been magnetized to a certain level. At the interrogation zone, a suitable oscillator provides an AC magnetic field at the predetermined frequency, and the marker mechanically resonates at this frequency upon exposure to the field when the bias element has been magnetized to a certain level along the length of the bias element. In a widely-used kind of magnetomechanical EAS system, the interrogation field is provided in pulses or bursts. A marker present in the interrogation field is excited by each burst, and after each burst is over, the marker undergoes a damped mechanical oscillation. The resulting signal radiated by the marker is detected by detecting circuitry which is synchronized with the interrogation circuit and arranged to be active during the quiet periods after bursts.

In a magnetomechanical EAS marker, the bias element functions as a control element. If it is desired to deactivate the magnetomechanical marker, the magnetic condition of the bias element is changed so that the bias element no longer provides the bias field required for the marker to resonate at the predetermined frequency of the detection equipment.

According to one known technique for deactivating a magnetomechanical marker, the bias element is degaussed by exposure to an AC magnetic field. According to another known technique, the magnetomechanical marker is brought into contact with, or very close to, an array of small permanent magnets arranged with alternating polarities. This breaks up the magnetization of the bias element along its length so that it no longer provides the bias field required to condition the magnetostrictive element for mechanical resonance.

It is also possible to deactivate a magnetomechanical marker by changing the orientation of magnetization of the bias element, so that the polarity of magnetization is oriented across the width of the bias element rather than along its length.

It is also known to provide control elements for harmonic markers. For example, a sequence of magnetic elements is mounted along the length of the harmonic marker. When these elements are in a demagnetized condition, the marker is activated and will produce harmonic perturbations in response to the interrogation signal. To deactivate the harmonic marker, the control elements are magnetized by exposing the marker to a strong DC magnetic field, generated, for example, by a permanent magnet or a DC-driven electromagnet. When the control elements are magnetized, the marker is prevented from causing the harmonic perturbations in the interrogation field.

As retail stores and shopping malls become larger, it is increasingly likely that both harmonic and magnetomechanical EAS systems will be in use in the same facility. For example, one department of a store may employ a magnetomechanical EAS system while another department employs a harmonic system. If a common checkout counter is shared by both departments, it would be necessary to provide at the checkout counter facilities for deactivating both types of marker. It could be contemplated to provide at the checkout counter a separate deactivation device for each type of marker, but this approach would be expensive and would take up too much space at the counter. It could also be attempted to use a single device of the type which generates a DC magnetic field to deactivate both types of marker, by magnetizing the control elements in the case of the harmonic markers, and by producing a widthwise magnetization in the control element of the magnetomechanical marker. However, such a device is not likely to provide reliable deactivation of the magnetomechanical marker because of difficulty in assuring that the field is applied in the correct orientation relative to the magnetomechanical marker. Also, for a magnetomechanical marker having a low-coercivity bias element, as disclosed in U.S. Pat. No. 5,729,200, it has been found that widthwise magnetization of the bias element is difficult to achieve, so that deactivation by application of a DC magnetic field is problematic. Moreover, the DC-field type of deactivation device would require both types of marker essentially to be brought into contact with the deactivation device, and is not suitable for the more desirable and efficient practice of "distance deactivation".

Another possible solution would be a deactivation device of the type which employs an alternating polarity array of permanent magnets. However, again this is a contact deactivation type of device, and although reliable deactivation of magnetomechanical markers can be expected, there would be a substantial possibility of failing to reliably deactivate harmonic type markers with this kind of device.

OBJECTS AND SUMMARY OF THE INVENTION

It is accordingly an object of the invention to provide a single deactivation device suitable for reliably deactivating both magnetomechanical and harmonic EAS markers.

It is a further object of the invention to provide such a dual-use deactivation device which performs distance deactivation, i.e., deactivation of the markers without bringing the markers into contact with the deactivation device.

According to an aspect of the invention, there is provided an apparatus adapted for deactivating two different types of EAS marker, including a housing, a first deactivation device, disposed within the housing, for deactivating a first one of the two types of EAS marker, and a second deactivation device, disposed within the housing and different from the first deactivation device, for deactivating the other one of the two types of marker. The first deactivation device may include a coil and circuitry for energizing the coil to radiate an AC magnetic field, and the coil may be arranged to surround the second deactivation device. The second deactivation device may be a permanent magnet. The apparatus may also be provided with structure for substantially isolating the DC magnetic field from the AC magnetic field. In a preferred embodiment, the AC magnetic field radiated by the coil has a peak amplitude that is substantially less than the level of the DC magnetic field formed by the permanent magnet. The AC field generated by the coil serves to degauss the control element of the magnetomechanical marker, thereby deactivating the magnetomechanical marker. The DC field generated by the permanent magnet serves to magnetize the control elements of the harmonic marker, thereby deactivating the harmonic marker. Preferably the control element of the magnetomechanical marker has a coercivity which is substantially below the coercivity of the control elements of the harmonic marker. The control element for the magnetomechanical marker may be of the type disclosed in the above-referenced U.S. Pat. No. 5,729,200, which has common inventors and a common assignee with the present application, and is entitled "Magnetomechanical Electronic Article Surveillance Marker with Bias Element Having Abrupt Deactivation/Magnetization Characteristic." By sweeping the marker, regardless of type, over the top surface of the deactivation apparatus in a manner so that it encounters the AC magnetic field after encountering the DC magnetic field, reliable deactivation of both types of marker can be assured. In the case of the magnetomechanical marker, having the relatively low-coercivity control element, the concluding exposure to the AC field degausses the control element and provides reliable deactivation. As to the harmonic marker, with the relatively high-coercivity control elements, the magnetized condition of the elements, caused by exposure to the DC magnetic field, is substantially unaffected by subsequent exposure to the relatively low level AC field.

The apparatus of the present invention thus allows for reliable deactivation of both magnetomechanical and harmonic type markers.

According to another aspect of the invention, there is provided a method of deactivating an EAS marker, including the steps of passing the marker through a first zone in which a magnetizing field is present, and passing the marker through a second zone in which an AC magnetic field is present. Preferably the passage through the AC magnetic field is performed after the passage through the magnetizing field.

The foregoing and other objects, features and advantages of the invention will be further understood from the following detailed description of preferred embodiments and practices thereof and from the drawings, wherein like reference numerals identify like components and parts throughout.

DETAILED DESCRIPTION OF PREFERRED EMBODIMENTS AND PRACTICES

Figure 1:
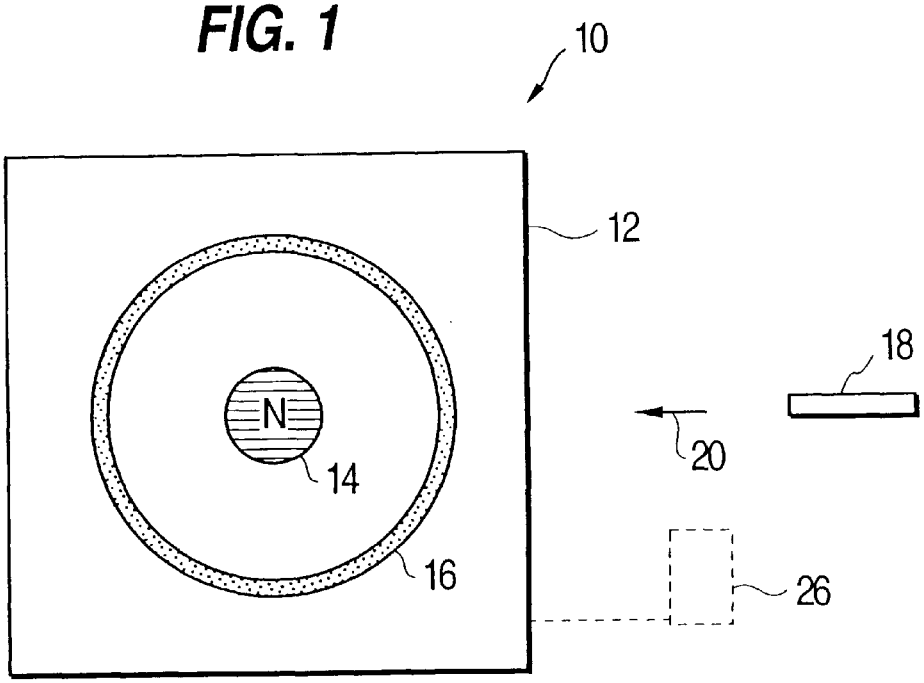
FIG. 1 is a schematic plan view of a deactivation apparatus provided in accordance with the invention, with the cover of the apparatus removed.

A first embodiment of the invention will now be described, initially with reference to FIG. 1. In FIG. 1, reference numeral 10 generally indicates a dual-use deactivation device provided in accordance with this embodiment of the invention. The deactivator 10 is shown in a plan view, and somewhat schematically, with the cover of the deactivator removed to show the main internal components.

Indicated at 12 is a housing which contains the internal components of the deactivator 10. The main internal components of the deactivator 10 are a permanent magnet 14 and a coil 16, for respectively forming a DC magnetic field and an AC magnetic field.

The permanent magnet 14 is disposed at a central position within the housing 12. The permanent magnet 14 is preferably cylindrical in shape, with one of its poles oriented upwardly. The permanent magnet 14 may be formed in a conventional manner using known materials.

The coil 16 is preferably circular and is disposed concentrically with the permanent magnet 14 and surrounding the permanent magnet 14. The deactivator 10 also includes circuitry (not shown) connected to the coil 16 for applying an AC driving signal to the coil 16 so that the coil 16 forms an AC magnetic field. Design of the driving circuitry for coil 16 is well within the capabilities of those of ordinary skill in the art, and therefore need not be described herein. For example, the coil could be excited by a step-down transformer off the power line.

Also shown in FIG. 1 is an EAS marker 18, which may be either a harmonic type marker or a magnetomechanical type marker. As indicated by the arrow 20 in FIG. 1, the marker 18 is swept over the deactivator 10 along a locus that traverses substantially the center of the deactivator 10 with the marker 18 having its long dimension oriented substantially radially with respect to the deactivator 10.

It is important that the markers 18 to be used in connection with the deactivator 10 in accordance with the invention be such that the control elements of the harmonic type markers have a coercivity that is substantially different from the coercivity of the control elements for the magnetomechanical type marker 18. For example, for markers to be used with a preferred embodiment of the invention, it is contemplated that the coercivity of the control elements of the harmonic type marker be substantially greater than the coercivity of the control elements of the magnetomechanical type markers. In particular, the coercivity of the control elements of the harmonic type markers may be about 100 Oe or greater. Accordingly, it is contemplated to use conventional harmonic type marker having control elements with a coercivity sufficiently high that exposure to a 40 Oe AC magnetic field would not have any substantial demagnetizing effect on the control elements of the harmonic marker.

Further, it is contemplated that the magnetomechanical type markers be formed with relatively low coercivity control elements such as those described in the above-referenced U.S. Pat. No. 5,729,200. The coercivity of the control elements in the magnetomechanical markers may be about 20 Oe.

Figure 2:
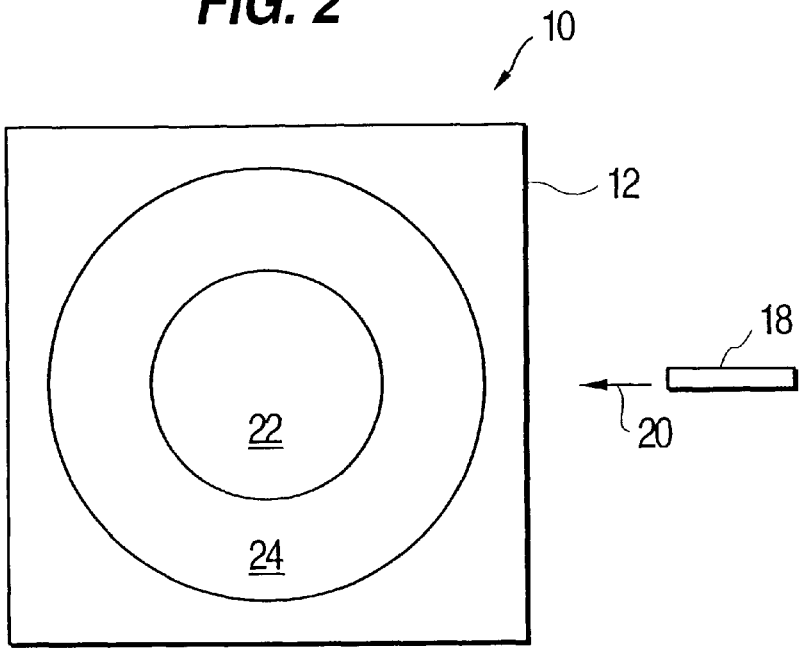
FIG. 2 is a schematic plan view of the apparatus of FIG. 1, showing two deactivation field zones formed by the apparatus.

FIG. 2 is another schematic plan view of the deactivator 10, and shows a DC magnetic field zone 22 and an AC magnetic field zone 24. The zones 22 and 24 correspond to the DC magnetic field formed by the permanent magnet 14 and the AC magnetic field formed by the coil 16, respectively. It will be observed that the zones 22 and 24 are concentric with each other and with the deactivator 10, with the zone 22 surrounded by the zone 24.

According to a preferred embodiment of the invention, suitable for use with conventional harmonic type markers and magnetomechanical markers having low-coercivity control elements as described above, the peak strength of the DC magnetic field in the zone 22 is substantially greater than the peak amplitude of the AC magnetic field in the zone 24. In particular, the level of the DC magnetic field in zone 22 is sufficiently high to magnetize the control elements of the harmonic type markers when the markers are swept over the deactivator 10 in the manner indicated by the arrow 20. The peak amplitude of the AC magnetic field is high enough to degauss the low-coercivity control elements of the magnetomechanical type markers, but is not high enough to degauss the control elements of the harmonic type markers.

In a preferred embodiment of the invention, the peak amplitude of the AC magnetic field in zone 24 is in excess of about 20 Oe, but no more than about 40 Oe, in a region extending for several inches upward from the top of deactivator 10. The level of the DC magnetic field at a central part of zone 22 is much higher than 40 Oe, and is sufficient to magnetize the control elements of the harmonic type marker.

In operation, when an active harmonic type marker is swept over the top of the deactivator 10 as indicated by the arrow 20, the harmonic type marker passes, in succession, through zone 24, then zone 22, and then through zone 24 again. The first passage of the harmonic type marker through the zone 24 has no effect on the control elements of the harmonic type marker, and, indeed, it can be assumed that the control elements are already in a demagnetized condition. Then, when the harmonic type marker passes through zone 22 the strong DC field formed by the permanent magnet 14 causes the control elements of the harmonic type marker to be magnetized, thereby placing the harmonic type marker in a deactivated condition. The subsequent passage of the harmonic type marker through zone 24 again has substantially no effect upon the magnetic condition of the control elements of the harmonic type marker because the level of the AC field present in the zone 24 is substantially lower than the level required to degauss the control elements of the harmonic type marker. Thus, the control elements of the harmonic type marker remain in a magnetized condition, and the marker remains in a deactivated condition, after passing through the zone 24 subsequent to passage through the zone 22.

If the active marker swept over the deactivator 10 is of the magnetomechanical type, the control element of the marker will experience the following effects, in sequence: degaussing of the control element during the first passage through zone 24, magnetization of the control element while passing through zone 22, and then degaussing of the control element during its second passage through zone 24. Because the peak level of the AC field in zone 24 is sufficient to degauss the low-coercivity control element of the magnetomechanical type marker, the "re-magnetization" of the control element during its passage through zone 22 is immediately overcome by its second passage through zone 24. The magnetomechanical type marker therefore emerges from its second passage through zone 24 in a deactivated condition, because the control element of the marker is in a degaussed condition.

It has been found that satisfactory operation of the deactivator 10 in regard to deactivating the magnetomechanical type marker requires that the DC field generated by the permanent magnet 14 be substantially isolated from the peripheral zone 24. It is believed that if a DC field of more than about 2 Oe is present in the zone 24, then the control element of the magnetomechanical type marker may retain a substantial degree of magnetization after its second passage through the zone 24. The isolation of the DC field from the zone 24 may be accomplished, for example, by providing a suitable amount of space between the permanent magnet 14 and the coil 16. In one arrangement, a distance of about 6 to 7 inches was found to be sufficient. However, if it is desired to reduce the size (in particular, the "footprint") of the deactivator 10, flux diverting members may be used to improve the isolation of the DC field from the zone 24.

Figure 3:
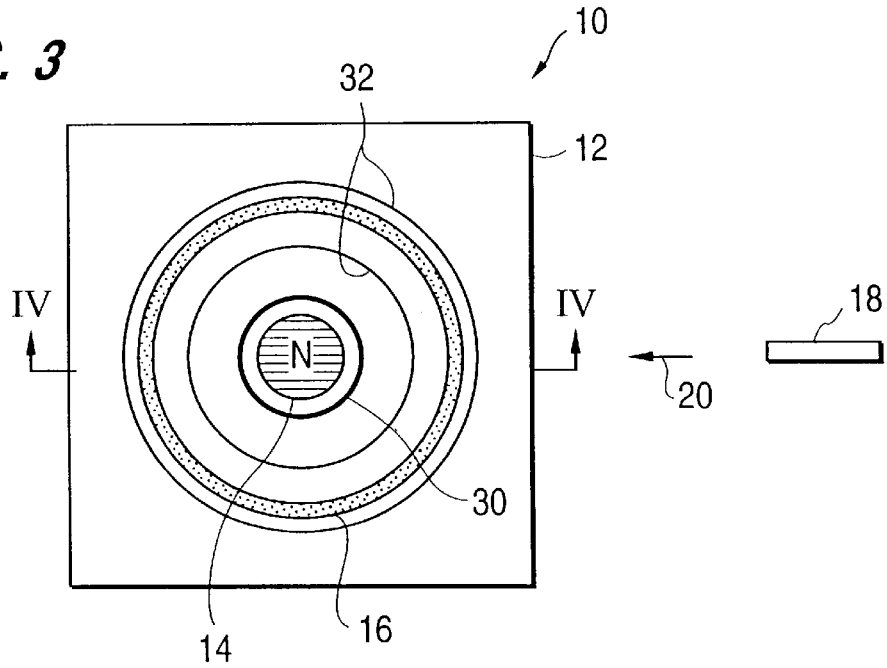
FIG. 3 is a schematic plan view, similar to FIG. 1, of another embodiment of the invention.
Figure 4:
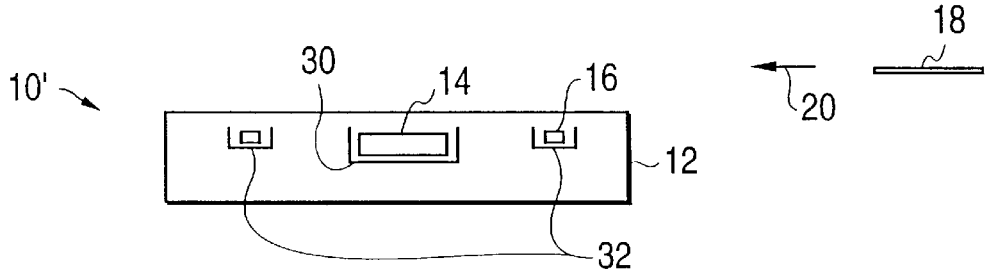
FIG. 4 is a schematic cross-sectional view taken at line IV—IV of FIG. 3.

An embodiment of the invention employing flux diverters is illustrated in FIGS. 3 and 4. The deactivator 10', according to this embodiment, includes the same permanent magnet 14 and coil 16 as deactivator 10 of FIGS. 1 and 2. In addition, the deactivator 10' includes flux diverting members 30 and 32. The flux diverter 30 is in the form of a cup or hollow cylinder open at the top and closed at the bottom and is positioned substantially concentric with the permanent magnet 14 so as to substantially enclose the permanent magnet 14 from below but not from above. Flux diverter 32 has the profile of a hollow circle when seen in plan view, and has a U-shaped cross-section so as to provide a circular channel in which coil 16 is disposed so that flux diverter 32 encloses coil 16 from below but not from above.

As an alternative to the flux diverters shown in FIGS. 3 and 4, it is contemplated to deploy around permanent magnet 14 smaller magnets of opposite polarity to provide a compensating DC magnetic field that substantially confines to zone 22 the DC field generated by magnet 14. Alternatively, an additional circular coil may be provided between magnet 14 and coil 16 and the additional coil may be DC-driven to provide the compensating DC field. As still another alternative, the coil 16 itself may be driven with a DC offset to compensate for DC field leakage into zone 24.

In either one of the embodiments described above, the circuitry for driving the coil 16 may be operated either in a continuous wave mode, or with a substantial duty cycle. Alternatively, the driving circuitry may be operated in a pulsed mode to generate the AC field in the zone 24 only when the presence of a marker is sensed. The sensing may be performed by an optical motion sensor (shown in phantom at 26 in FIG. 1), or may utilize conventional marker detection circuitry. In the latter case, the AC field would be generated only when a marker of the magnetomechanical type is sensed.

It is also contemplated to generate the DC field in the zone 22 in a pulsed manner, by replacing the permanent magnet 14 with a coil driven by DC pulses. The pulsed DC field may be generated in response to either optical sensing of motion or in response to circuitry which detects the presence of a harmonic type marker. It is also contemplated to substitute for the permanent magnet 14 a coil driven continuously or at frequent intervals with a DC signal.

Figure 5:
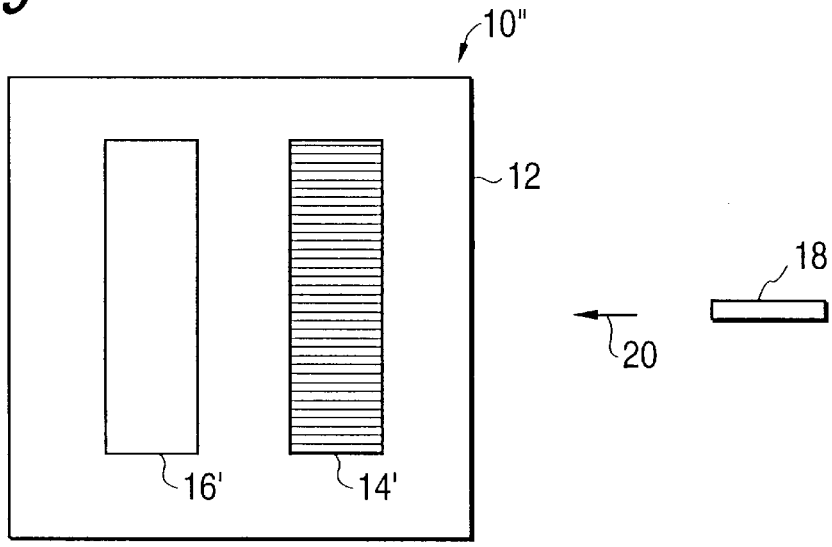
FIG. 5 is a schematic plan view, similar to FIGS. 1 and 3, of a third embodiment of the apparatus.

Another embodiment of the deactivator is shown in FIG. 5, and is generally indicated by reference numeral 10". In this embodiment, a permanent magnet 14' and a coil 16' are arranged side by side within the housing 12. The permanent magnet 14' and coil 16' are for forming, respectively, a DC magnetic field and an AC magnetic field. As before, the maximum amplitude of the AC field is substantially below the peak level of the DC field. Consequently, a marker of the harmonic type, when swept over the top of the deactivator 10" in the direction indicated by arrow 20, has its control elements magnetized by passing over the magnet 14', and the magnetized condition of the control elements is not substantially changed by passing over the coil 16'. On the other hand, a marker of the magnetomechanical type, including a low-coercivity control element, is deactivated by passing over the coil 16' after having passed over the permanent magnet 14'. It is to be understood that a marker of the harmonic type would also be deactivated by having its control elements magnetized if it were swept in the opposite direction to that indicated by arrow 20. Such, however, is not the case with respect to a magnetomechanical type marker. If a magnetomechanical marker were swept across the deactivator 10" in the direction opposite to arrow 20, the control element of the magnetomechanical type marker would be degaussed by passing over the coil 16' but would then once again be magnetized after having passed over the permanent magnet 14'. Consequently, if swept in the direction opposite to the arrow 20, the magnetomechanical marker would remain in an activated condition. Thus, the deactivator of FIG. 5 is less advantageous than the previous embodiments, in that the radial direction in which the marker is swept over the device is critical with respect to the embodiment of FIG. 5, but not with respect to the previous embodiments.

Figure 6:
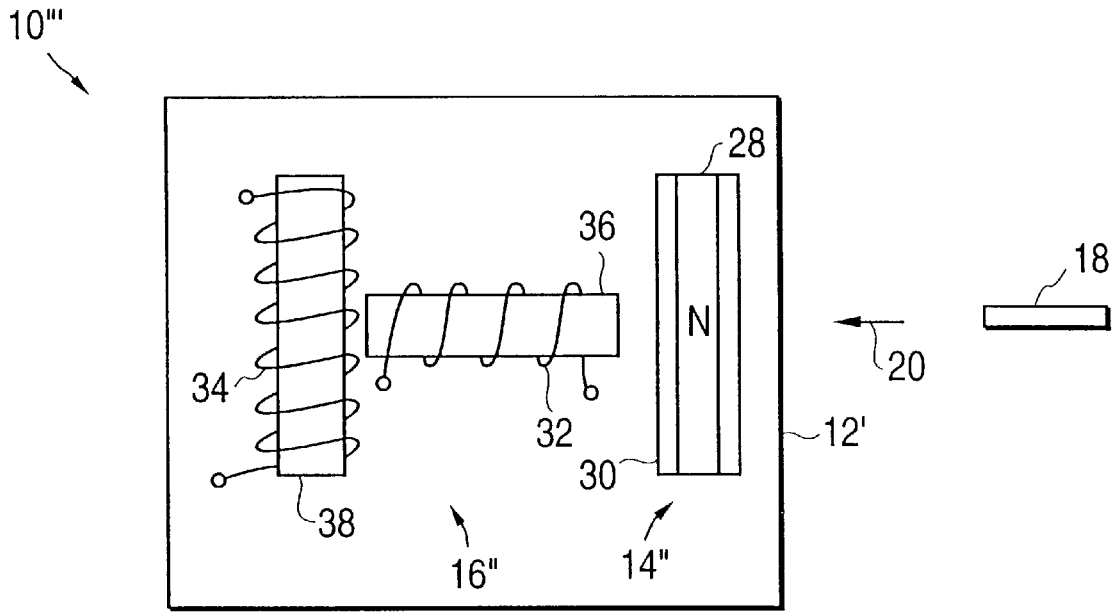
FIG. 6 is a schematic plan view of a fourth embodiment of the invention.

The effective magnetic field provided by the coil 16' in the horizontal direction indicated in arrow 20 may be significantly different in amplitude from the field provided by coil 16' in the horizontal direction that is perpendicular to the direction indicated by arrow 20. Consequently, the effectiveness of the device 10" in deactivating a magnetomechanical marker may be dependent on the orientation of the marker when presented for deactivation. FIG. 6 illustrates an embodiment of the invention which operates to deactivate a magnetomechanical marker substantially irrespective of the orientation of the marker.

The deactivation device 10'" shown in FIG. 6 includes a housing 12' which contains a permanent magnet arrangement 14" and a coil array 16". The magnet arrangement 14" is formed of a permanent bar magnet 28 held in a keeper 30 which is U-shaped in cross section. The coil array 16" is made up of coils 32 and 34 in a T-configuration, with coil 32 wound on a ferromagnetic core 36 and coil 34 wound on a ferromagnetic core 38. (Coils 36 and 38 are shown as being rather sparse; in a commercial embodiment the number of turns may be in the hundreds. Also, circuitry for driving the coils 36 and 38 with an AC signal or signals is omitted to simplify the drawing.) Coil 36 provides a strong alternating magnetic field in the direction indicated by arrow 20, and coil 38 provides a strong alternating magnetic field in the horizontal direction perpendicular to the direction indicated by arrow 20. As a result, if a magnetomechanical marker is swept in the direction and at the locus indicated by arrow 20, deactivation can be reliably achieved irrespective of the marker's orientation. The permanent magnet arrangement 14" of FIG. 6 operates in the same manner as the permanent magnet of FIG. 5 to deactivate harmonic markers.

It should be understood that the coil array 16" of FIG. 6 can be modified in a number of respects, including changing the coil geometry, or omitting the cores 36 and 38, while still providing the preferred feature of a substantially omnidirectional alternating field.

For the embodiments previously described it has been assumed that the control elements of the magnetomechanical type markers have a significantly lower coercivity than the control elements of the harmonic type markers. However, according to an alternative practice, the control elements of the harmonic type markers may have a lower coercivity than those of the magnetomechanical type markers. In that case, apparatus may be provided so that the labels pass through a DC magnetic field at a relatively low level after passing through a relatively high amplitude AC magnetic field.

In all cases, it is to be understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. An apparatus adapted for deactivating two different types of EAS marker, comprising:

a housing;

first deactivation means, disposed within said housing, for deactivating a first one of said two types of EAS marker, said first deactivation means including a coil and means for energizing said coil to radiate an AC magnetic field, said coil surrounding a second deactivation means; and said second deactivation means, disposed within said housing and different from said first deactivation means, for deactivating the other one of said two types of marker.

2. An apparatus according to claim 1, wherein said second deactivation means is a permanent magnet.

3. An apparatus according to claim 2, wherein said AC magnetic field radiated by said coil has a peak amplitude that is substantially less than an amplitude of a DC magnetic field formed by said permanent magnet.

4. An apparatus according to claim 3, wherein said first type of marker is a magnetomechanical marker and said other type of marker is a harmonic marker.

5. An apparatus according to claim 4, further comprising means for substantially isolating said DC magnetic field from said AC magnetic field.

6. An apparatus according to claim 1, wherein said means for energizing operates continuously.

7. An apparatus according to claim 1, wherein said means for energizing is operated intermittently.

8. An apparatus according to claim 7, further comprising sensor means for optically sensing motion in the vicinity of said housing and for triggering said means for energizing upon sensing said motion.

9. An apparatus according to claim 1, wherein at least one of said first and second deactivation means continuously generates a respective magnetic field.

10. An apparatus according to claim 9, wherein each one of said first and second deactivation means continuously generates a respective magnetic field.

11. An apparatus according to claim 1, wherein said first and second deactivation means simultaneously generate respective magnetic fields.

12. An apparatus for deactivating an EAS marker, comprising:

a housing;

first deactivation means, disposed within said housing, for generating an AC magnetic field in a first zone; and second deactivation means, disposed within said housing, for generating a DC magnetic field in a second zone, said first and second zones being concentric, with said second zone inside said first zone.

13. An apparatus according to claim 12, wherein said second deactivation means continuously generates said DC magnetic field.

14. An apparatus according to claim 13, wherein said second deactivation means includes a permanent magnet.

15. An apparatus according to claim 12, wherein said second deactivation means intermittently generates said DC magnetic field.

16. An apparatus according to claim 12, wherein said first deactivation means continuously generates said AC magnetic field.

17. An apparatus according to claim 12, wherein said first deactivation means intermittently generates said AC magnetic field.

18. An apparatus according to claim 17, wherein said first deactivation means includes a coil and means for energizing said coil to radiate said AC magnetic field.

19. An apparatus according to claim 18, further comprising sensor means for optically sensing motion in the vicinity of said housing and for triggering said means for energizing upon sensing said motion.

20. An apparatus according to claim 12, wherein said first and second deactivation means simultaneously generate said AC magnetic field and said DC magnetic field, respectively.

21. An apparatus according to claim 12, wherein said AC magnetic field has a peak amplitude that is substantially lower than an amplitude of said DC magnetic field.

22. An apparatus according to claim 12, further comprising means for substantially isolating said DC magnetic field from said AC magnetic field.

23. An apparatus according to claim 22, wherein said means for isolating includes a first flux diverter in which said first deactivation means is positioned, and a second flux diverter in which said second deactivation means is positioned.

24. A method of deactivating an EAS marker used in a harmonic-type EAS system, the marker including a magnetic control element, the method comprising the steps of:

passing the marker through a first zone in which a magnetizing field is present; and passing the marker through a second zone in which an AC magnetic field is present;

said second passing step being performed after said first passing step; and said magnetic control element having a coercivity substantially higher than a peak amplitude of said AC magnetic field and lower than a level of said magnetizing field, whereby said magnetic control element is substantially magnetized by passage through said first zone and remains substantially magnetized after passage through said second zone.

25. A method of deactivating an EAS marker used in a magnetomechanical-type EAS system, the marker including a magnetic control element, the method comprising the steps of:

passing the marker through a first zone in which a magnetizing field is present; and passing the marker through a second zone in which an AC magnetic field is present;

said second passing step being performed after said first passing step; and said magnetic control element having a coercivity substantially lower than a peak level of said AC magnetic field, whereby said magnetic control element is substantially demagnetized by passage through said second zone.

26. A method according to claim 25, further comprising the step of optically sensing motion of said marker to trigger generation of at least one of said magnetizing field and said AC magnetic field.

* * * * *